US006079938A

United States Patent [19]

Anderson et al.

[11] Patent Number: 6,079,938

[45] Date of Patent: Jun. 27, 2000

[54] COMBINATION STEP/STOP ARRANGEMENT FOR A SKID STEER LOADER

[75] Inventors: Robert S. Anderson, Garner; Mirza Q. Baig, Sanford; Jeffrey A. Deneve, Sanford; Brian R. Dershem, Sanford; Hasan A. Kabir, Sanford; Rodney D. McLamb, Cary; Richard A. Naugle, Fuquay-Varina, all of N.C.; Huan T. Nguyen, Forth Worth, Tex.; Kevin E. Pielmeier, Apex, N.C.; Matthew P. Rosefsky, Haverford, Pa.

[73] Assignee: Caterpillar Inc., Peoria, Ill.

[21] Appl. No.: 09/090,696

[22] Filed: Jun. 5, 1998

[51] Int. Cl.[7] ..... B66F 9/06; F02F 9/00

[52] U.S. Cl. ..... 414/685; 414/914

[58] Field of Search ..... 414/685, 722, 414/914

[56] References Cited

U.S. PATENT DOCUMENTS

| | | | |
|---|---|---|---|
| 3,734,534 | 5/1973 | Brooks, Jr. et al. | 280/163 |
| 3,887,216 | 6/1975 | Perry | 280/163 |
| 3,976,164 | 8/1976 | Miller | 182/89 |
| 4,324,412 | 4/1982 | Wulff | 280/163 |
| 4,400,002 | 8/1983 | Stillmunkes | 280/164 A |
| 4,626,163 | 12/1986 | Link et al. | 414/685 |
| 5,171,124 | 12/1992 | Foster | 414/722 X |

*Primary Examiner*—F. J. Bartuska
*Attorney, Agent, or Firm*—O. G. Pence

[57] ABSTRACT

A skid steer loader has a pair of lift arms pivotally mounted to a main frame of the loader. The lift arms are connected together by a cross member located at the forward ends of the arms. The cross member is spaced ahead of a front wall member of the main frame when the lift arms are in their lowered positions so as to create a gap between the cross member and the cross member and the front wall member of the main frame where the operator enters the loader. A combination step/stop arrangement is carried on the front wall member to provide a skid resistant stepping surface across the gap between the front wall member of the main frame and the cross member of the lift arm assembly and to prevent the lift arm assembly from moving past its lowered position.

7 Claims, 4 Drawing Sheets

COMBINATION STEP/STOP ARRANGEMENT FOR A SKID STEER LOADER

TECHNICAL FIELD

The present invention relates to a combination step/stop arrangement located between the front wall of the main frame of a skid steer loader and a front lift arm cross member, to serve both as a stop for the loader lift arms and as a step for facilitating entry into and out of the operator compartment of the loader.

BACKGROUND ART

Skid steer loaders are highly maneuverable self-propelled loaders which have lift arms that can be used to raise and lower loads at the front of the loaders. The loaders have operator compartments accessible from the front. The lift arms are pivoted at the rear of a main frame of the loader and extend forwardly along the sides of the operator compartment.

A pair of hydraulic lift cylinders are utilized for raising and lowering the lift arms. Each lift cylinder is pivotally mounted between a respective one of the lift arms and the main frame of the loader. Such lift cylinders are subject to damage when high impact loads are exerted on them during use. High impact loads can occur if the piston of the lift cylinder bottoms out against the head of the cylinder to stop a bucket that is dropped from its raised position, for instance. Other impact loads may be experienced by the lift cylinders when forward movement of the skid steer loader is abruptly stopped, as when driving a lowered bucket into the ground in an attempt to fill the bucket. In some prior skid steer loaders, a separate lift arm stop is mounted to each side of the main frame so as to engage a respective one of the lift arms when the lift arms are lowered to their lowered positions. Such stops prevent the lift cylinders from bottoming out, thus eliminating one source of impact loads on the lift cylinders.

Such skid steer loaders also have a front cross member that joins the lift arms immediately in front of the operator's compartment. The cross member is adjacent, but spaced from, a front wall of the loader main frame when the lift arms are in a lowered position. The cross member has to be rigid enough to serve the purpose of holding the lift arms together and to support one or a pair of hydraulic cylinders for tilting a front mounted bucket or other implement mounted to the lift arms. In some prior skid steer loaders, the cross member has been made wide enough to eliminate any gap between it and the front wall of the main frame so as to serve as a stepping surface when entering or exiting the operator compartment of the loader. However, it is also desirable to make the cross member as narrow as possible (in fore and aft direction), in order to help visibility of the load when the lift arms are raised during operation. A narrower lift arm cross member also reduces the amount of material accumulation on the cross member. Unfortunately, a narrow cross member reduces the stepping area for the operator and creates a gap between the front frame wall and the cross member into which the operator's foot might slip when entering or exiting the operator compartment.

The above problems have been addressed in the past by separate solutions. For instance, the two "needs" for the lift arm cross member present conflicting demands, namely keeping the cross member small for visibility improvement and reducing accumulation of material on the cross member, while on the other hand keeping the top wall of the cross member wide for good operator footing has been addressed in a manner shown in U.S. Pat. No. 5,078,568, which employs a strap step to fill the gap between the from frame member and the cross member when a narrow cross member is used. This structure, however, does not address the need to provide a lift arm stop to prevent damage to the lift cylinders of the loader. The combination step/stop of the present invention satisfies all of these diverse needs with an integral cooperative arrangement, which is simple and inexpensive to construct.

DISCLOSURE OF THE INVENTION

The present invention relates to a skid steer loader having a main frame with a front wall member. A lift arm assembly includes a pair of lift arms and a cross member. Each lift arm has a forward end and an opposite rearward end with each rearward end being pivotally mounted to the main frame for movement of such arms between raised and lowered positions. The cross member extends between the lift arms and is spaced ahead of the front wall member of the main frame by a predetermined gap when the lift arms are in their lowered position. A combination step/stop arrangement is carried on the front wall member to provide a skid resistant stepping surface across the gap between the front wall member of the main frame and the cross member of the lift arm assembly and to prevent the lift arm assembly from moving past its lowered position.

BEST MODE FOR CARRYING OUT THE INVENTION

Figure 1:
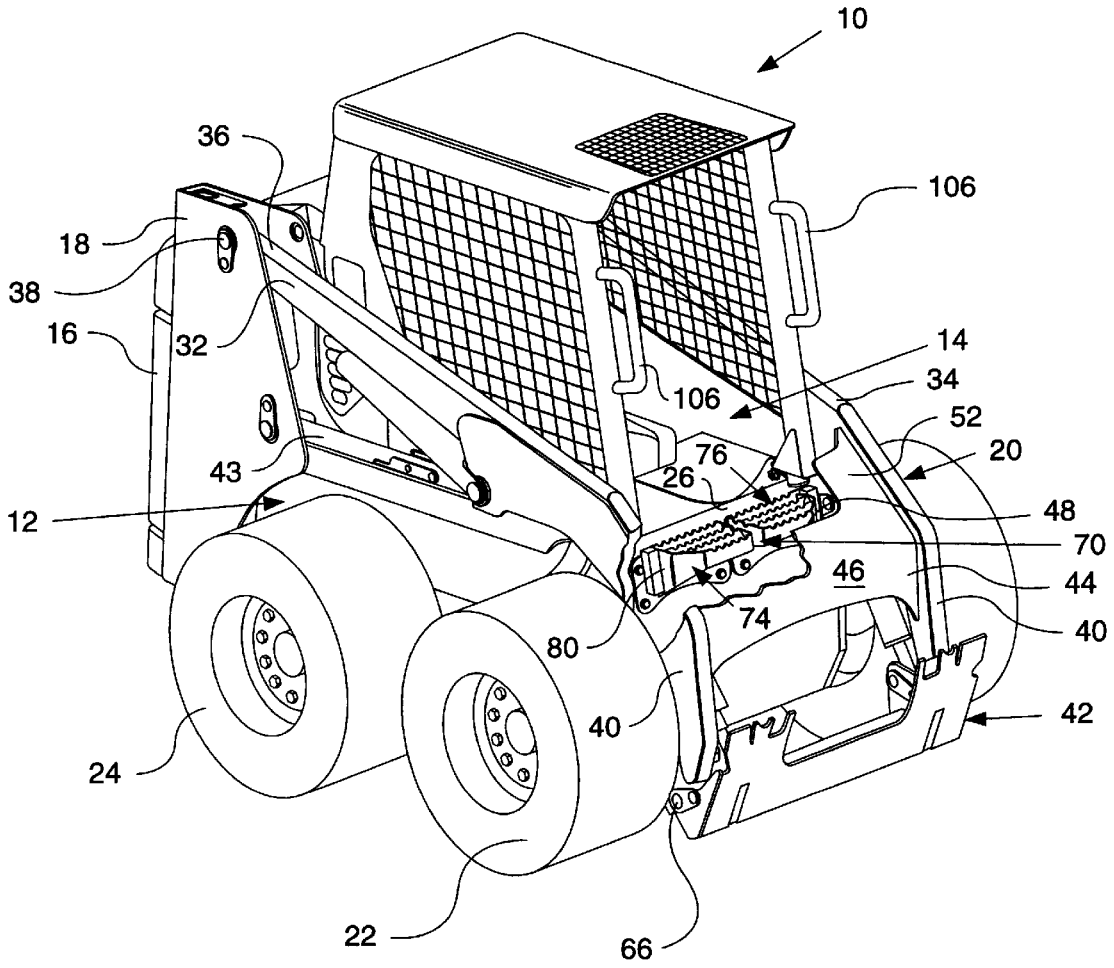
FIG. 1 is a perspective view of a skid steer loader with a portion of one lift arm broken away to illustrate a combination step/stop arrangement constructed in accordance with the present invention attached to a front wall of a main loader frame.

As best shown in FIG. 1, a rigid frame skid steer loader 10 includes a mainframe 12 which supports a protected operator's compartment 14 with an engine 16 at the rear. A pair of laterally spaced upright rear support members, one shown at 18, are located at the rear of the main frame 12 and are used to mount a loader lift arm assembly 20. Power from engine 16 is transmitted to the front and rear drive wheels 22,24 of the loader in a conventional manner.

The main frame 12 includes a front wall member 26. The front wall member 26 has a generally upright front wall 28 and a top wall 30 disposed at a particular vertical height to afford convenient access into or exit from the operator compartment 14 from the front of the loader 10.

Figure 2:
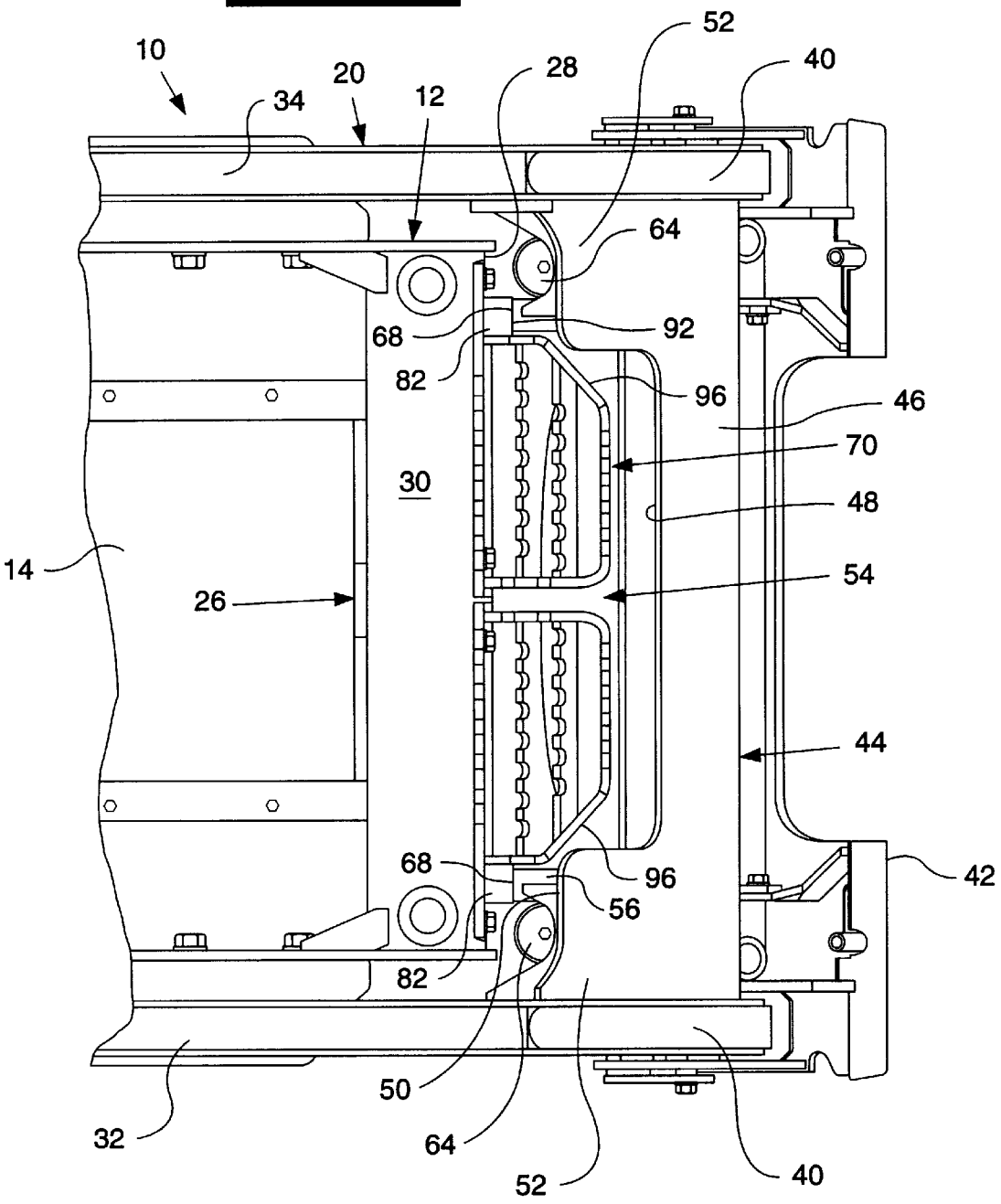
FIG. 2 is an enlarged top plan view of the step/stop arrangement shown in FIG. 1.
Figure 3:
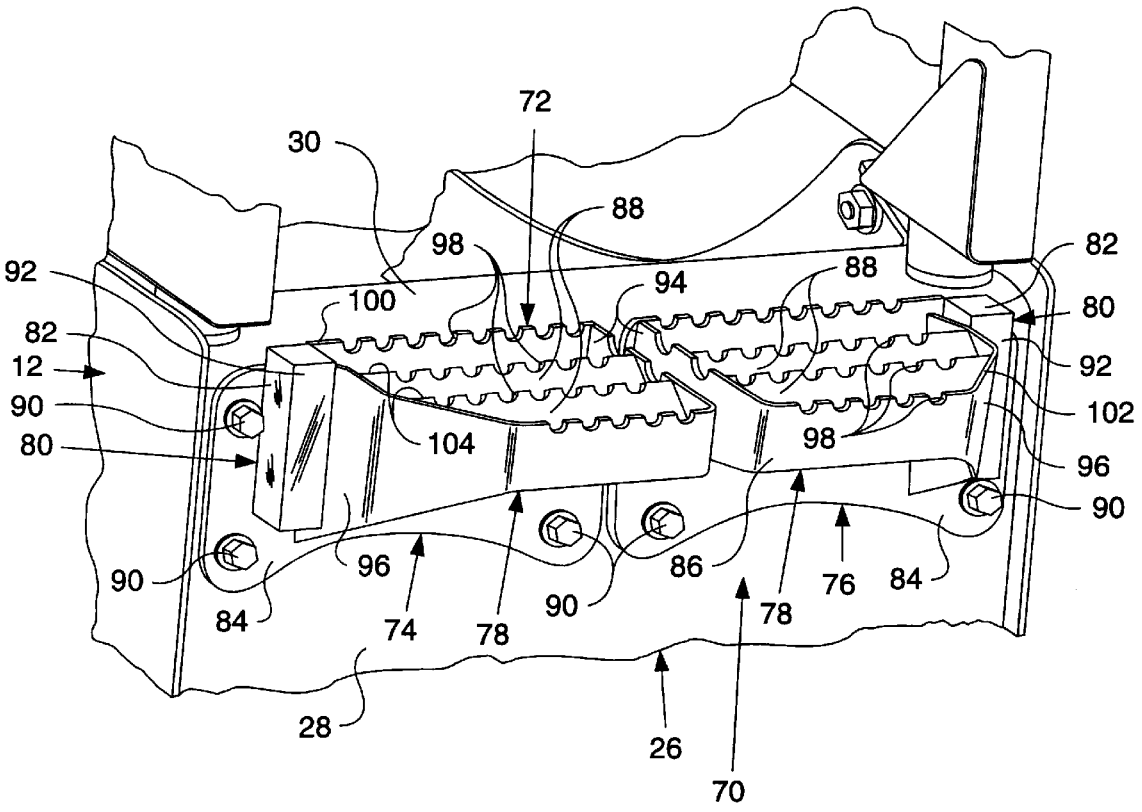
FIG. 3 is an enlarged perspective view of the step/stop arrangement shown in FIG. 2.

As best shown in FIGS. 2 and 3, lift arm assembly 20 has individual first and second lift arms 32,34, each having a rearward end 36 which is pivotally mounted on a suitable pivot pin such as shown at 38 to the upper ends of their respective upright support members 18. The lift arms 32,34 extend forwardly along their respective side of the loader main frame 12 and have forward distal end portions 40 which extend downwardly in front of the loader 10. The forward distal end portions 40 pivotally mount a suitable tool attachment member indicated generally at 42, which is shown only schematically. The member 42 is used for mounting a bucket or other tool (not shown) onto the lift arms 32,34. A hydraulic lift cylinder 43 (FIG. 1) is pivotally mounted between each of the lift arms 32,34 and the main frame 12 for raising and lowering the lift arms 32,34 between respective raised and lowered positions.

The forward end portions 40 of the lift arms 32,34 are joined together with a front lift arm cross member 44. The lift arm cross member 44 preferably has a formed upper plate 46 with a generally U-shaped cut-out 48 along its upper edge 50 and defining a pair of side extensions 52. The cut-out 48 is provided to decrease the fore-to-aft width of the cross member 44 for increased visibility of the bucket or tool attached to the lift arms 32,34 and to make the cross member 44 narrower to reduce the amount of material accumulation on the cross member. The cut-out 48 is spaced ahead of the front wall member 26 which provides a gap 54 (FIG. 2) between the cross member 44 and the front wall member 26 of the main frame 12.

Figure 4:
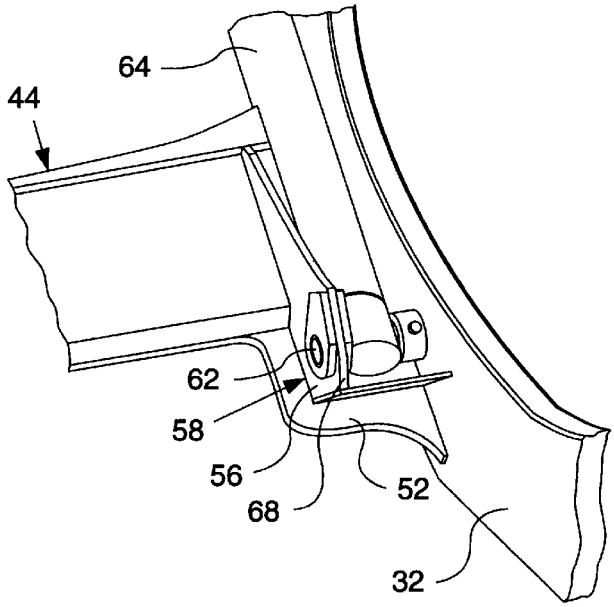
FIG. 4 is an enlarged fragmentary perspective view of the underside of a portion of the lift arm and its cross member to illustrate a stop surface provided on a clevis bracket thereof.
Figure 5:
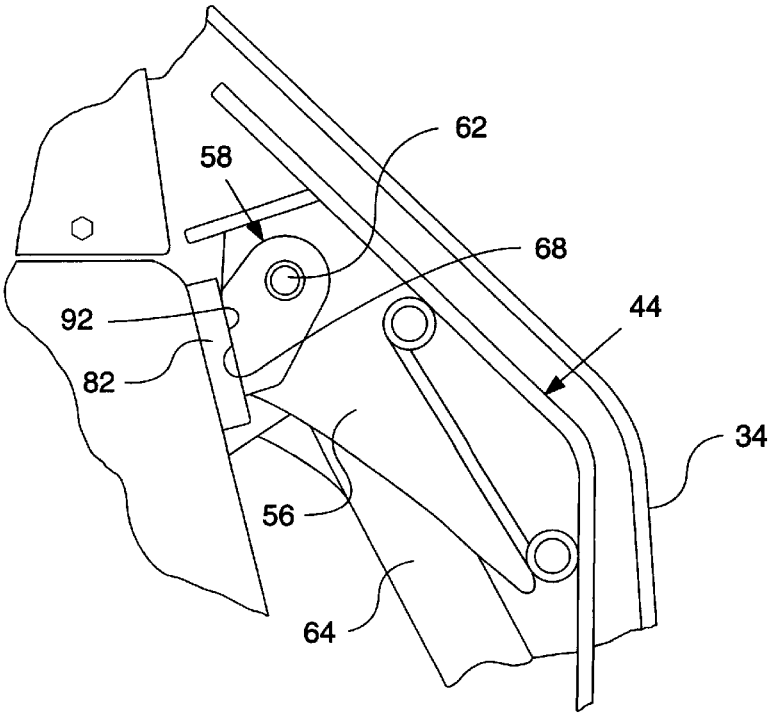
FIG. 5 is an fragmentary side view of the bracket illustrated in FIG. 4 and a stop block of the step/stop arrangement to illustrate the relationship between the stop surface on the bracket with a corresponding stop surface on the stop block.

As shown in FIGS. 4 and 5, a pin mounting bracket 56 is attached to the underside of each side extension 52 in a spaced relation to a respective one of the lift arms 32,34 which, along with a respective adjacent side of the lift arm form a pair of clevises, one of which is shown at 58 in FIG. 4. A pair of pivot pins 62 pivotally mounts one end of pair of hydraulic tilt cylinders 64 to a respective one of the devises 58 of the lift arms 32,34. The opposite ends of each tilt cylinder 64 are pivotally attached to the tool attachment member 42 for pivoting the attachment member 42 about pivot pins 66 that mount the attachment member 42 to the lift arms 32,34. Each of the pin brackets 56 is provided with a planar stop surface 68 thereon.

In accordance with the present invention, the skid steer loader 10 includes a combination step/stop arrangement 70 (FIG. 3) carried on the front wall member 26 of the main frame 12 to provide a skid resistant stepping surface 72 across the gap 54 between the front wall member 26 of the main frame 12 and the cross member 44 of the lift arm assembly 20, and to prevent the lift arm assembly 20 from moving past its lowered position. Preferably, the combination step/stop arrangement 70 includes a pair of separate step/stop members 74,76, each step/stop member having a step portion 78 and a stop portion 80. Each of such step/stop members 74,76 is preferably detachably mounted to the front wall member 26 where the step portions 78 are disposed in side-by-side relationship to each other in the gap 54 between the front wall member 26 and the cross member 44. Each of the stop portions 80 is disposed and adapted to engage a respective one of stop surfaces 68 of the lift arms 32,34 when each of the lift arms is lowered to its lowered position such that the lift arm is prevented from pivotal movement beyond its lowered position so as to prevent the lift cylinders from bottoming out and to transfer any rearward longitudinal loads exerted on the forward end portions 40 of the lift arms 32,34 into the stop portions 80 and into the front wall member 26 of the main frame 12.

Each step/stop member 74,76 includes a stop block 82, a base plate 84, a U-shaped step member 86 and one or more stiffener plates 88. Each base plate 84 is separately detachably secured by bolts 90 to the front wall 28 of the front wall member 26. Bolts 90 may be fitted through slotted or oversize apertures in the base plate 84 for adjusting the position of the step/stop members for alignment purposes. U-shaped step member 86 is attached to the base plate 84 in a suitable manner, such as by welding. Each stop block 82 is attached to its respective base plate 84 by welding at a location such that a forwardly facing stop surface 92 thereon is disposed in a position to contact the stop surface 68 on a respective one of the pin brackets 56 on the cross member 44. Each U-shaped step member 86 has an inner side leg 94 and an outer side leg 96, with each outer side leg 96 being attached immediately adjacent its stop block 82 and being angled in an outwardly direction for guiding the pin bracket stop surface 68 toward engagement with the stop surface 92 on the stop block 82 in the event of any lateral misalignment therebetween due to side forces acting on the lift arms 32,34.

As shown in the drawings, each step/stop member 74,76 preferably includes two stiffener plates 88 extending between and welded to the side legs 94,96 of the U-shaped member 86. It is also important to note that the stiffener plates 88 are angled forwardly from top to bottom such that they are disposed in general alignment with line of vision of the operator in the operator's compartment 14 so as to increase the visibility through the step portions 80,82 for viewing the bucket or tool when the lift arms 32,34 are in their lowered position. In addition, one or more of the base plate 84, U-shaped step member 86 and stiffener plates 88 preferably have a serrated portion 98 along their top edges 100,102,104, respectively, to provide each step/stop member 74,75 with a skid-resistant stepping surface.

As can be seen, when lift arms 34 are in their lowered positions shown in FIG. 1, the top edges 100,102,104 of the step/stop members 74,76 lie substantially along the plane of top wall 30 of the front wall member 26 and slightly above the level of the top rear edge 50 of the cross member 44. Thus, the step/stop members 74,76 are at a level to support the operator's foot when entering or leaving the operator's compartment 14. The operator steps on the step/stop members 74,76 and moves between the lift arms 32,34. Handle grips 106 are provided along the opposite sides of the operator compartment 12 for the operator.

INDUSTRIAL APPLICABILITY

The construction of the present step/stop arrangement 70 conveniently integrates a step function for operator entry into and exit from a skid steer loader 10 with a stop function for eliminating impact loads on the lift cylinder of the loader. The angled side leg 96 of each U-shaped step member 86 is adapted to contact its respective pin mounting bracket 56 in order to guide its stop surface 68 into alignment with the respective stop surface 92 of the stop blocks 82 in the event of their misalignment due to any lateral loads exerted on the lift arms 32,34.

The respective stop surfaces 68,92 are adapted to engage each other before the lift cylinders 43 bottom out when the lift arms 32,34 reach their lowered position. The respective stop surfaces 68,92 are also in contact with each other when the lift arms 32,34 are in their lowered positions in order to transfer longitudinal loads directly into the main frame 12, rather than carrying such loads through the lift cylinders 43. Thus, the lift cylinders 32,34 are relieved from high impact loads in the event that the bucket is allowed to drop or when the forward movement of the loader 10 is stopped abruptly due to resistance of the bucket with the ground when digging.

The step/stop members 74,76 are preferably separate as shown to allow their individual adjustment for alignment of their stop surfaces 92 with the stop surfaces 68 on the lift arms 32,34. Being separate also prevents lateral shifting of one of the step/stop members due to side impact loads thereon from effecting the alignment of the other.

Although the present invention has been described with reference to preferred embodiments, workers skilled in the art will recognize that changes may be made in form and detail without departing from the spirit and scope of the invention.

What is claimed is:

1. A skid steer loader having a main frame with a front wall member, comprising:

a lift arm assembly including a pair of lift arms and a cross member, each lift arm having a forward end portion and an opposite rearward end with each rearward end being pivotally mounted to the main frame for movement of such arm assembly between a raised position and a lowered position, and said cross member extending between the lift arms and spaced ahead of the front wall member of said main frame so as to define a gap therebetween when the lift arm assembly is in its lowered position; and a combination step/stop arrangement carried on said front wall member of said main frame to provide a skid resistant stepping surface across the gap between the front wall member of the main frame and the cross member of the lift arm assembly, and to prevent the lift arm assembly from moving past its lowered position, said combination step/stop including a pair of separate step/stop members, each step/stop member having a step portion and a stop portion, each of such step/stop members being mounted to said front wall member where said step portions are disposed in side-by-side relationship to each other in said gap between said front wall member and said cross member.

2. The skid steer loader of claim 1 wherein said lift arm assembly includes a pair of lift cylinders, each lift cylinder being pivotally connected to a respective one of said lift arms and adapted to raise and lower said lift arm assembly between its raised and lowered positions, and wherein each of said stop portions is disposed and adapted to engage a respective one of said lift arm assembly when said lift arm is lowered to its lowered position such that said lift arm assembly is prevented from pivotal movement beyond said lowered position so as to prevent said lift cylinders from bottoming out and to transfer any rearward longitudinal loads exerted on the forward end portions of said lift arms into the front wall member of said main frame.

3. The skid steer loader of claim 2 wherein said skid steer loader includes a tool attachment member pivotally mounted to the forward end portions of said lift arms of the lift arm assembly and a pair of tilt cylinders, each of said tilt cylinders having one end pivotally connected to said tool attachment member and its opposite end pivotally connected to a respective one of a pair of clevises carried on lift arm assembly, each of said devises including a pin bracket carried on said cross member in a spaced relation to a respective one of said lift arms, each of said pin brackets having a planar stop surface thereon adapted to engage a respective one of said stop portions when said lift arm assembly is lowered to its lowered position to transfer longitudinal loads on said tilt cylinder into said stop portion.

4. The skid steer loader of claim 3 wherein each of said step/stop members includes a base plate, a U-shaped step member and one or more stiffener plates, said base plate being detachably secured to a front wall of said front wall member with said U-shaped step member having opposite side legs and being attached to said base plate and said stiffener plate extending between and attached to the side legs of said U-shaped member.

5. The skid steer loader of claim 4 wherein said front wall member has a top wall disposed at a particular vertical height and said base plate, U-shaped step member and said stiffener plate of said step/stop members each have top edges, said top edges being disposed at a vertical height generally equivalent to the height of said top wall.

6. The skid steer loader of claim 4 wherein the base plate, U-shaped step member and stiffener plates each have a top edge, each of said top edges having a serrated portion therealong to provide skid-free stepping surface.

7. The skid steer loader of claim 6 wherein said cross member has a pin bracket with a stop surface, and wherein each of said stop portions includes a stop block with a stop surface and each U-shaped step member has an outer side leg attached immediately adjacent its stop block and being angled in an outwardly direction for guiding the pin bracket stop surface toward engagement with the stop surface on the stop block in the event of any lateral misalignment therebetween due to side forces acting on the lift arms.

* * * * *